US011433507B2

(12) United States Patent
Wu

(10) Patent No.: US 11,433,507 B2
(45) Date of Patent: Sep. 6, 2022

(54) WHEEL WEIGHT PLIERS

(71) Applicant: Pi-Liang Wu, Taichung (TW)

(72) Inventor: Pi-Liang Wu, Taichung (TW)

( * ) Notice: Subject to any disclaimer, the term of this patent is extended or adjusted under 35 U.S.C. 154(b) by 203 days.

(21) Appl. No.: 16/706,866

(22) Filed: Dec. 9, 2019

(65) Prior Publication Data

US 2020/0238480 A1 Jul. 30, 2020

(30) Foreign Application Priority Data

Jan. 28, 2019 (TW) ..... 108103197

(51) Int. Cl.

| | |
|---|---|
| ***B25B 7/02*** | (2006.01) |
| ***B25B 27/00*** | (2006.01) |
| ***B25B 7/22*** | (2006.01) |
| ***B25F 1/00*** | (2006.01) |

(52) U.S. Cl.

CPC ..... *B25B 7/02* (2013.01); *B25B 27/0078* (2013.01); *B25B 7/22* (2013.01); *B25F 1/006* (2013.01)

(58) Field of Classification Search

CPC ..... B25B 7/22; B25B 27/0078; B25F 1/006

USPC ..... 81/15.2; 7/100

See application file for complete search history.

(56) References Cited

U.S. PATENT DOCUMENTS

| | | | | | |
|---|---|---|---|---|---|
| 974,021 | A * | 10/1910 | Blake | B25D 1/02 | 81/25 |
| 2,883,153 | A * | 4/1959 | Abbott | B25B 27/0078 | 254/131 |
| 5,575,029 | A | 11/1996 | Simpson | | |
| 5,586,584 | A * | 12/1996 | Haldemann | B21F 9/02 | 140/123.5 |
| 9,044,844 | B1 | 6/2015 | Barnhart et al. | | |
| 2011/0314614 | A1 | 12/2011 | Barnhart | | |
| 2018/0009095 | A1* | 1/2018 | Liao | B25B 7/02 | |

FOREIGN PATENT DOCUMENTS

| | | | | |
|---|---|---|---|---|
| EP | 3043964 B1 * | 11/2017 | ..... | B25B 27/0078 |
| TW | M328348 | 3/2008 | | |
| TW | M505385 | 7/2015 | | |
| TW | M369838 | 4/2016 | | |
| TW | M565095 | 8/2018 | | |

* cited by examiner

*Primary Examiner* — Hadi Shakeri

(57) ABSTRACT

Wheel weight pliers contains: a first lever, a second lever, a connection shaft, and a spring. The first lever includes a first grip section and a first work section. The second lever includes a second grip section, a second work section, and a third work section. The first work section has a hook, and a width of two sides of the hook decreases from a root of the hook to a distal end of the hook. The second work section has a blade portion, and the third work section has a hammer. The hammer has a fitting element. The first grip section has multiple recesses adjacent to the second grip section. Two ends of a respective one recess extend on two sides of the first grip section. The second grip section has a notch formed proximate to the first grip section, and the notch faces the multiple toothed ribs.

2 Claims, 6 Drawing Sheets

WHEEL WEIGHT PLIERS

FIELD OF THE INVENTION

The present invention relates to a hand tool for vehicle maintenance, and more particularly to wheel weight pliers.

BACKGROUND OF THE INVENTION

A counterweight is fixed on a wheel rim of a vehicle so that the vehicle runs stably, and the counterweight is an adhesive counterweight or a hangable counterweight.

The adhesive counterweight contains a weight unit and an adhesion unit fixed on a side of the weight unit, wherein the weight unit is made of metal, and the adhesion unit has a detachable film adhered thereon.

When the adhesive counterweight is fixed on the wheel rim, the detachable film is removed so that the weight unit is fixed on the wheel rim by using the adhesive counterweight.

When desiring to remove the adhesive counterweight from the wheel rim, long nose pliers are applied to clamp and detach the weight unit. Alternatively, a knife is employed to cut the adhesion unit so as to remove the weight unit from the wheel rim.

DE 19611815A1 and EP 3043964B1 disclosed a removal tool for an adhesive counterweight.

A hangable counterweight (clip-on wheel weight) contains a weight unit and a hook, wherein the weight unit is made of metal, the hook has a bending portion and a connection portion connected with the bending portion, wherein the bending portion is arcuate and has an opening and a through orifice, the connection portion is coupled with the weight unit, and an opening is defined between a peripheral side of the bending portion and the weight unit.

When fixing the hangable counterweight to the wheel rim, the hook contacts with the wheel rim, the bending portion is hit so that wheel rim forces the bending portion to deform and to engage with the wheel rim, thus fixing the hangable counterweight.

The hangable counterweight is removed from the wheel rim, and an elongated removal tool is inserted into the through orifice of the bending portion to pull the hook so as to detach the bending portion from the wheel rim, thus removing the hangable counterweight from the wheel rim.

The present invention has arisen to mitigate and/or obviate the afore-described disadvantages.

SUMMARY OF THE INVENTION

The primary objective of the present invention is to provide wheel weight pliers which are capable of removing an adhesive counterweight and a hangable counterweight from a wheel rim, and the wheel weight pliers are capable of fixing the hangable counterweight to the wheel rim.

Wheel weight pliers provided by the present invention contains: a first lever, a second lever, a connection shaft, and a spring.

The first lever is rotatably connected with a second lever by using the connection shaft so that the first lever is rotated relative to the second lever along the connection shaft.

The first lever includes a first grip section formed on an end thereof, a first work section formed on the other end of the first lever and curvedly connected with the first grip section, the second lever includes a second grip section formed on an end thereof, a second work section and a third work section which are both formed on the other end of the second lever. The second grip section is curvedly connected with the second work section and the third work section, the first grip section is opposite to the second grip section, the first work section is opposite to the second work section, and the spring is defined between the first work section and the second work section so as to force the first work section and the second work section to expand outwardly.

The first work section has a hook extending from a distal end of the first work section to the second work section, and a width of two sides of the hook decreases from a root of the hook to a distal end of the hook. The second work section has a blade portion formed on a distal end thereof, and the third work section has a hammer arranged on a distal end thereof, the hammer has a fitting element fitted thereon and made of plastic.

The first grip section has multiple recesses formed adjacent to the second grip section, the multiple recesses are parallel to one another, and two ends of a respective one recess extend on two sides of the first grip section, such that a respective one of multiple toothed ribs is formed between any two adjacent recesses of the multiple recesses, the second grip section has a notch formed proximate to the first grip section, wherein the notch faces the multiple toothed ribs.

Accordingly, the wheel weight pliers are capable of removing or connecting the adhesive counterweight from or with the wheel rim without using any other tools. In addition, the wheel weight pliers are capable of fixing the hangable counterweight to the wheel rim.

DETAILED DESCRIPTION OF THE PREFERRED EMBODIMENTS

Figure 1:
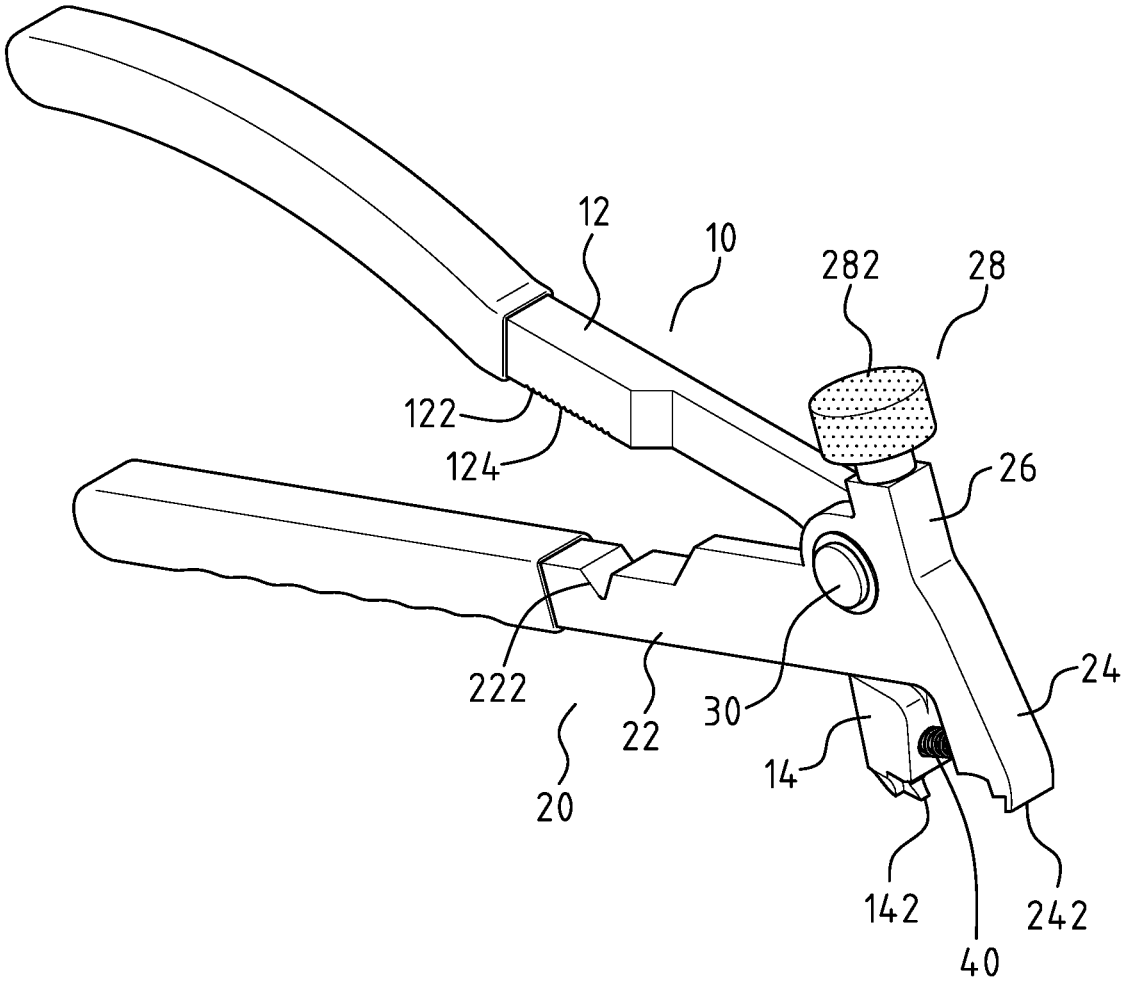
FIG. 1 is a perspective view showing the assembly of wheel weight pliers according to a preferred embodiment of the present invention.
Figure 2:
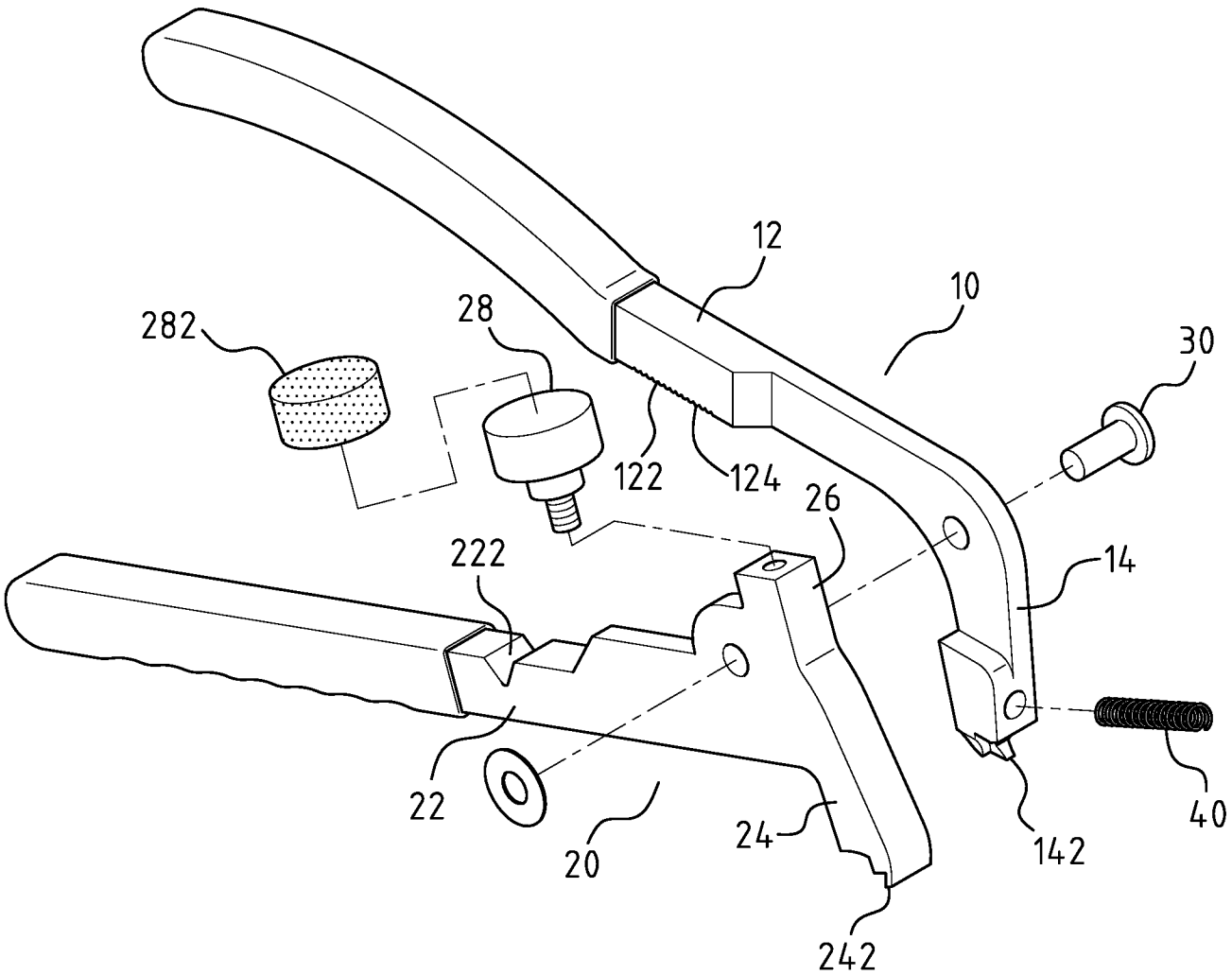
FIG. 2 is a perspective view showing the exploded components of the wheel weight pliers according to the preferred embodiment of the present invention.
Figure 3:
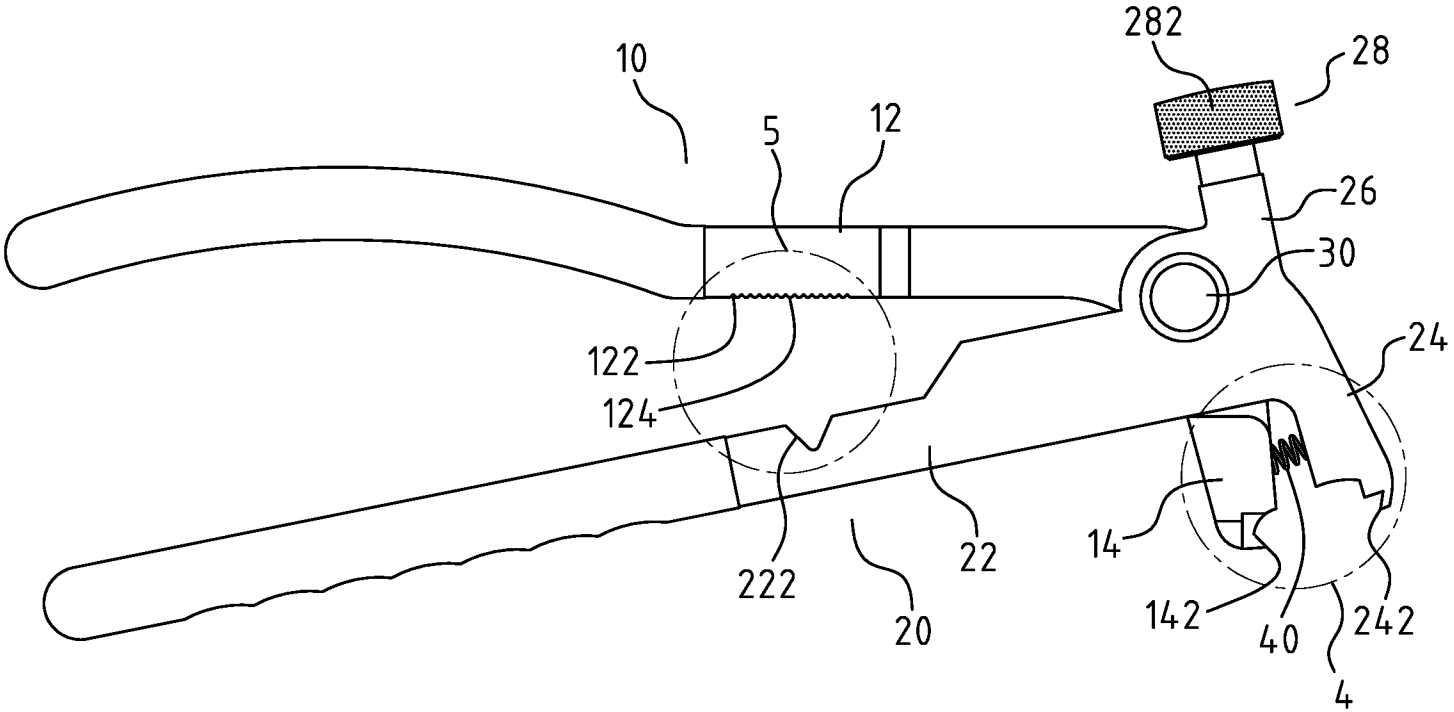
FIG. 3 is a side plan view showing the assembly components of the wheel weight pliers according to the preferred embodiment of the present invention.

With reference to FIGS. 1-3, wheel weight pliers according to a preferred embodiment of the present invention comprise: a first lever 10, a second lever 20, a connection shaft 30, and a spring 40.

The first lever 10 is rotatably connected with a second lever 20 by using the connection shaft 30 so that the first lever 10 is rotated relative to the second lever 20 along the connection shaft 30.

The first lever 10 includes a first grip section 12 formed on an end thereof, a first work section 14 formed on the other end of the first lever 10 and curvedly connected with the first grip section 12. The second lever 20 includes a second grip section 22 formed on an end thereof, a second work section 24 and a third work section 26 which are both formed on the other end of the second lever 20, wherein the second grip section 22 is curvedly connected with the second work section 24 and the third work section 26, the first grip section 12 is opposite to the second grip section 22, the first work section 14 is opposite to the second work section 24, and the spring 40 is defined between the first work section 14 and the second work section 24 so as to force the first work section 14 and the second work section 24 to expand outwardly.

Figure 4:
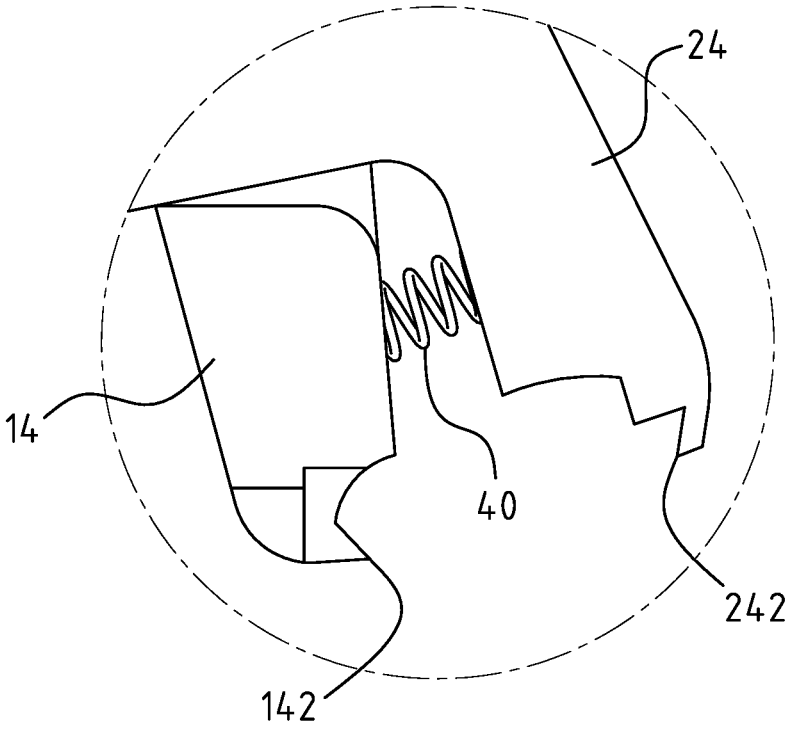
FIG. 4 is a side plan view showing a part of FIG. 3.

Referring to FIG. 4, the first work section 14 has a hook 142 extending from a distal end of the first work section 14 to the second work section 24, wherein a width of two sides of the hook 142 decreases from a root of the hook 142 to a distal end of the hook 142, such that the distal end of the hook 142 is sharp so as to hook a bending portion of a counterweight. The second work section 24 has a blade portion 242 formed on a distal end thereof, and the third work section 26 has a hammer 28 arranged on a distal end thereof so as to hit the bending portion of the counterweight. The hammer 28 is screwed with the third work section 26 and has a fitting element 282 fitted thereon, wherein the fitting element 282 is made of plastic.

Figure 5:
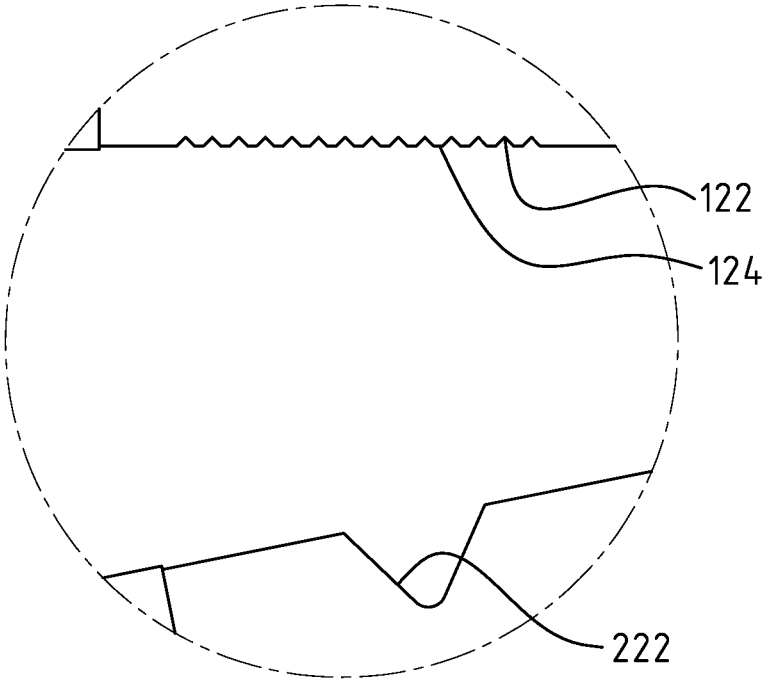
FIG. 5 is a side plan view showing another part of FIG. 3.

As shown in FIG. 5, the first grip section 12 has multiple recesses 122 formed adjacent to the second grip section 22, wherein the multiple recesses 122 are parallel to one another, two ends of a respective one recess 122 extend on two sides of the first grip section 12, such that a respective one of multiple toothed ribs 124 is formed between any two adjacent recesses 122 of the multiple recesses 122. The second grip section 22 has a notch 222 formed proximate to the first grip section 12, wherein when the first grip section 12 is rotated close to the second grip section 22 along the connection shaft 30, the notch 222 faces the multiple toothed ribs 124.

Figure 6:
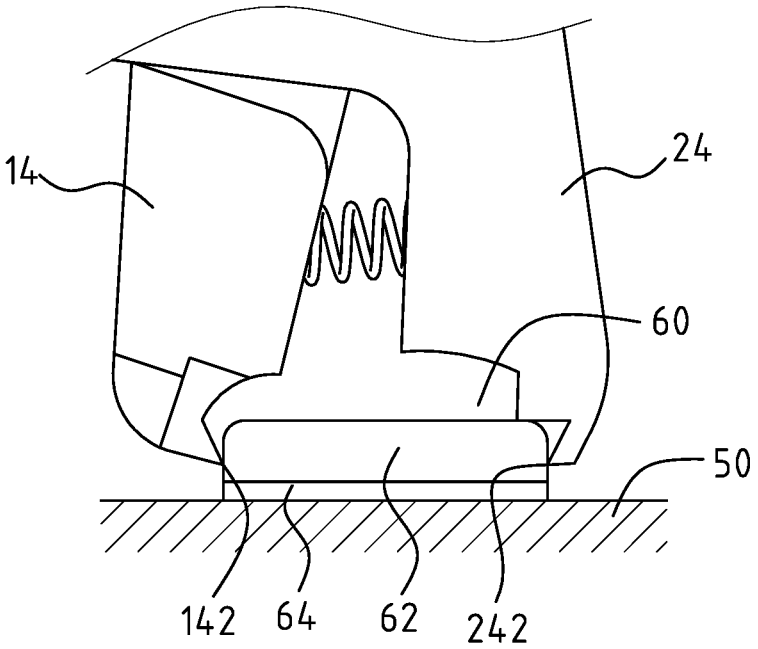
FIG. 6 is a side plan view showing the operation of the wheel weight pliers according to the preferred embodiment of the present invention.

As illustrated in FIG. 6, when removing an adhesive counterweight 60 from a wheel rim 50 of a vehicle by ways of the wheel weight pliers, the first work section 14 and the second work section 24 are moved to a weight unit 62 of the adhesive counterweight 60 so that the hook 142 and the blade portion 242 are adjacent to two ends of the weight unit 62 respectively, and the first grip section 12 and the second grip section 22 are pressed so that the hook 142 and the blade portion 242 contact with and move the two ends of the weight unit 62 respectively, such that an adhesion unit 64 of the counterweight 60 is torn so as to detach the weight unit 62. Thereafter, the adhesion unit 64 is eliminated from the wheel rim 50 by ways of a scraper or other removal tools. After pressing the first grip section 12 and the second grip section 22 so that the hook 142 and the blade portion 242 contact with the two ends of the weight unit 62 respectively, the hook 142 is movably inserted into the adhesion unit 64 of the weight unit 62 so as to tear the adhesion unit 64, thus removing the weight unit 62.

Figure 7:
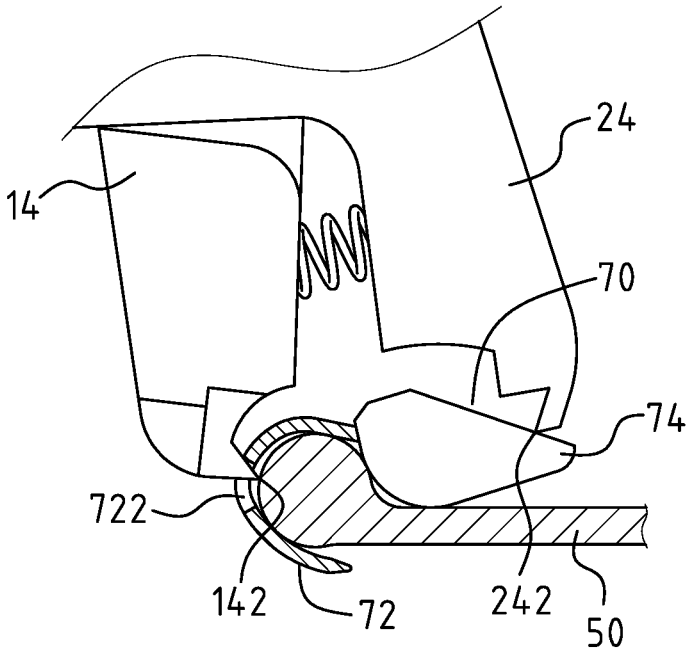
FIG. 7 is a cross sectional view showing the operation of the wheel weight pliers according to the preferred embodiment of the present invention.

As illustrated in FIG. 7, when removing a hangable counterweight 70 from the wheel rim 50, the hook 142 is inserted into a through orifice 722 of a bending portion 72 of a counterweight 70, and the blade portion 242 contacts with the weight unit 74 of the hangable counterweight 70.

Figure 8:
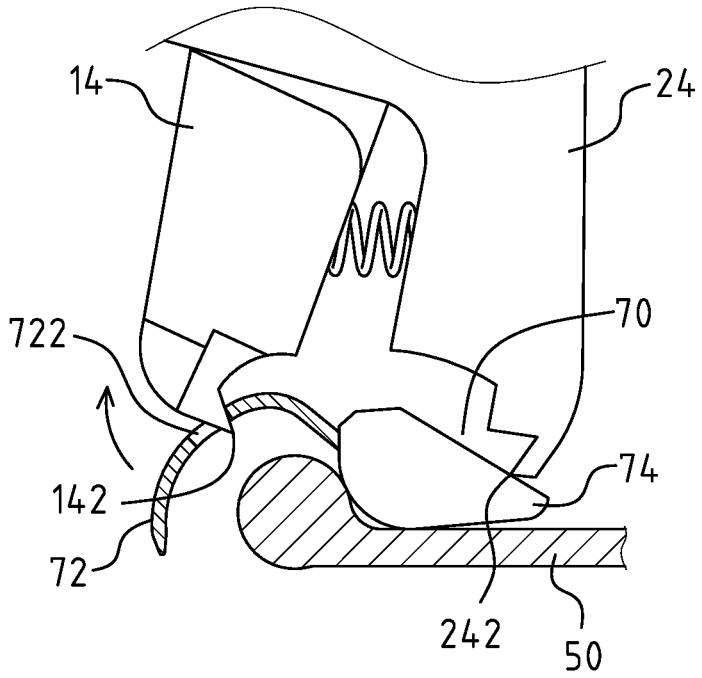
FIG. 8 is also another cross sectional view showing the operation of the wheel weight pliers according to the preferred embodiment of the present invention.

With reference to FIG. 8, the blade portion 242 contacts with the weight unit 74 so as to rotate the removal tool, wherein the hook 142 engages and rotates the bending portion 72 away from the wheel rim 50, thus detaching the hangable counterweight 70 from the wheel rim 50.

Figure 9:
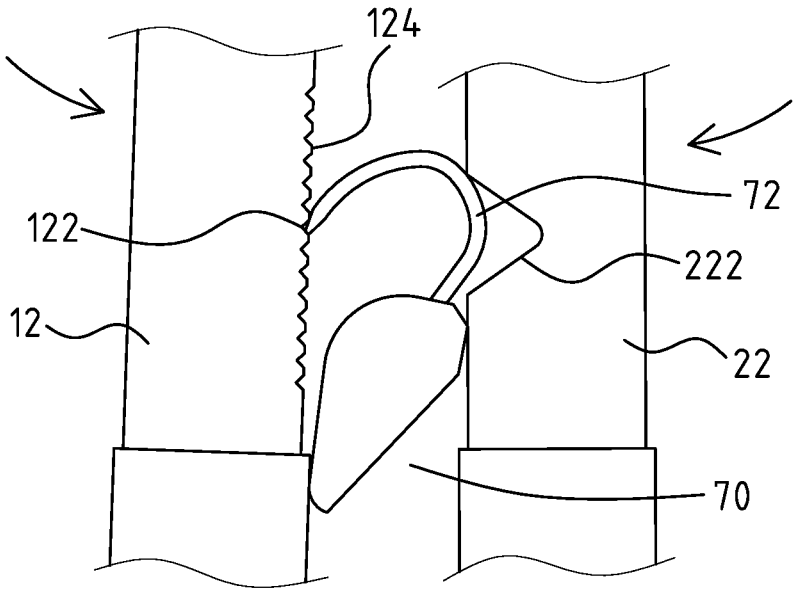
FIG. 9 is another side plan view showing the operation of the wheel weight pliers according to the preferred embodiment of the present invention.

When removing the hangable counterweight 70, the hook 142 engages and rotates the bending portion 72 away from the wheel rim 50, so the bending portion 72 deforms to increase a width between a peripheral side of the bending portion 72 and the weight unit 74, and an inner diameter of the bending portion 72 increases such that the counterweight 70 is not fixed to the wheel rim 50. Referring further to FIG. 9, the counterweight 70 is defined between the first grip section 12 and the second grip section 22 so that a middle section of the bending portion 72 engages into the notch 222, and the bending portion 72 retains into any one of the multiple recesses 122. Thereafter, the first grip section 12 and the second grip section 22 are pressed manually so that the first grip section 12 forces the peripheral side of the bending portion 72 to the weight unit 74, the inner diameter of the bending portion 72 decreases. Thereby, the counterweight 70 is fixed on the wheel rim 50 so that the bending portion 72 engages with the wheel rim 50, and the counterweight 70 is fixed to the peripheral side of the wheel rim 50.

When the counterweight 70 is fixed to the wheel rim 50 and the bending portion 72 is hit by the hammer 28, the bending portion 72 deforms to engage the wheel rim 50. Preferably, the fitting element 282 is fitted on the hammer 28 so that when the hammer 28 hits the bending portion 72 and the hammer 28 hits the wheel rim 50 carelessly, the fitting element 282 avoids deformation of the wheel rim 50.

Accordingly, the wheel weight pliers are capable of removing or connecting the adhesive counterweight from or with the wheel rim without using any other tools. In addition, the wheel weight pliers are capable of fixing the hangable counterweight to the wheel rim.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. Wheel weight pliers comprising: a first lever, a second lever, a connection shaft, and a spring;

wherein the first lever is rotatably connected with the second lever by using the connection shaft so that the first lever is rotated relative to the second lever along the connection shaft;

wherein the first lever includes a first grip section formed on an end thereof, a first work section formed on the other end of the first lever and curvedly connected with the first grip section, the second lever includes a second grip section formed on an end thereof, a second work section and a third work section which are both formed on the other end of the second lever, wherein the second grip section is curvedly connected with the second work section and the third work section, the first grip section is opposite to the second grip section, the first work section is opposite to the second work section, and the spring is defined between the first work section and the second work section so as to force the first work section and the second work section to expand outwardly;

wherein the first work section has a hook extending from a distal end of the first work section to the second work section, wherein a width of two sides of the hook decreases from a root of the hook to a distal end of the hook, the second work section has a blade portion formed on a distal end thereof, and the third work section has a hammer arranged on a distal end thereof, the hammer has a fitting element fitted thereon and made of plastic;

wherein the first grip section has multiple recesses formed adjacent to the second grip section, wherein the multiple recesses are parallel to one another, two ends of a respective one recess extend on two sides of the first grip section, such that a respective one of multiple toothed ribs is formed between any two adjacent recesses of the multiple recesses, the second grip section has a notch formed proximate to the first grip section, wherein the notch faces the multiple toothed ribs;

wherein when a counterweight is defined between the first grip section and the second grip section, a middle section of a bending portion engages into the notch, and the bending portion retains into any one of the multiple recesses, the first grip section and the second grip section are pressed manually so that the first grip section forces a peripheral side of the bending portion to a weight unit, an inner diameter of the bending portion decreases, such that the counterweight is fixed on a wheel rim so that the bending portion engages with the wheel rim, and the counterweight is fixed to a peripheral side of the wheel rim;

wherein when removing an adhesive counterweight from the wheel rim, the first work section and the second work section are moved to a weight unit of the adhesive counterweight so that the hook and the blade portion are adjacent to two ends of the weight unit respectively, and the first grip section and the second grip section are pressed so that the hook and the blade portion contact with and move the two ends of the weight unit respectively, such that an adhesion unit of the counterweight is torn so as to detach the weight unit; after pressing the first grip section and the second grip section so that the hook and the blade portion contact with the two ends of the weight unit respectively, the hook is movably inserted into the adhesion unit of the weight unit so as to tear the adhesion unit, thus removing the weight unit;

wherein when removing a hangable counterweight from the wheel rim, the hook is inserted into a through orifice of the bending portion of the counterweight, and the blade portion contacts with the weight unit of the hangable counterweight so as to rotate the removal tool, wherein the hook engages and rotates the bending portion away from the wheel rim, thus detaching the hangable counterweight from the wheel rim.

2. The wheel weight pliers as claimed in claim 1, wherein the hammer is screwed with the third work section.

* * * * *